US011702850B2

(12) United States Patent
Cox

(10) Patent No.: US 11,702,850 B2
(45) Date of Patent: Jul. 18, 2023

(54) WALL STRUCTURE WITH HORIZONTAL BASE STUD

(71) Applicant: Michael Elliott Cox, St. Louis, MO (US)

(72) Inventor: Michael Elliott Cox, St. Louis, MO (US)

( * ) Notice: Subject to any disclaimer, the term of this patent is extended or adjusted under 35 U.S.C. 154(b) by 0 days.

(21) Appl. No.: 17/666,456

(22) Filed: Feb. 7, 2022

(65) Prior Publication Data

US 2022/0251821 A1 Aug. 11, 2022

Related U.S. Application Data

(60) Provisional application No. 63/238,841, filed on Aug. 31, 2021, provisional application No. 63/146,668, filed on Feb. 7, 2021.

(51) Int. Cl.

| | |
|---|---|
| ***E04F 19/04*** | (2006.01) |
| ***E04B 1/00*** | (2006.01) |
| ***E04B 2/70*** | (2006.01) |
| ***E04B 2/58*** | (2006.01) |
| ***E04C 3/07*** | (2006.01) |
| ***E04B 2/60*** | (2006.01) |
| ***E04B 1/70*** | (2006.01) |
| *E04C 3/04* | (2006.01) |

(52) U.S. Cl.

CPC ..... *E04F 19/049* (2013.01); *E04B 1/0023* (2013.01); *E04B 1/7038* (2013.01); *E04B 2/58* (2013.01); *E04B 2/60* (2013.01); *E04B 2/70* (2013.01); *E04C 3/07* (2013.01); *E04F 19/04* (2013.01); *E04F 19/0481* (2013.01); *E04F 19/0495* (2013.01); *E04C 2003/0443* (2013.01); *E04F 2019/0445* (2013.01)

(58) Field of Classification Search

CPC ..... E04B 1/0023; E04B 1/7038; E04B 2/58; E04B 2/60; E04C 3/07; E04C 2003/0443; E04F 19/04; E04F 19/0481; E04F 19/049; E04F 19/0495; E04F 2019/0445

See application file for complete search history.

(56) References Cited

U.S. PATENT DOCUMENTS

| | | | | | |
|---|---|---|---|---|---|
| 1,488,090 | A * | 3/1924 | Buhr | E04F 19/04 | D23/389 |
| 1,555,392 | A * | 9/1925 | Tracy | E04F 19/04 | 52/287.1 |
| 1,652,282 | A * | 12/1927 | Lacey | E04F 19/0495 | 52/288.1 |
| 2,203,119 | A * | 6/1940 | Wollaeger | E04F 19/0468 | 52/718.02 |
| 3,956,861 | A * | 5/1976 | Rasmussen | E04B 2/7854 | 52/718.05 |
| 4,622,791 | A | 11/1986 | Cook et al. | | |

(Continued)

FOREIGN PATENT DOCUMENTS

| | | | | |
|---|---|---|---|---|
| FR | 2729417 A1 * | 7/1996 | E04F 19/0463 |
| GB | 2169935 A * | 7/1986 | E04F 19/0463 |
| GB | 2519324 A * | 4/2015 | E04F 19/04 |

*Primary Examiner* — Jessie T Fonseca

(57) ABSTRACT

A wall structure having a horizontal base stud, which wall structure has an upper wall panel, and a horizontal base stud, wherein the base stud has openings to allow for liquids to escape in the event of a plumbing leak, and additional openings to allow for air flow from the exterior to the interior of the wall structure.

10 Claims, 9 Drawing Sheets

(56) References Cited

U.S. PATENT DOCUMENTS

| | | | | |
|---|---|---|---|---|
| D324,575 | S | 3/1992 | Davis | |
| 9,016,021 | B1 | 4/2015 | McBride | |
| 9,663,944 | B1 | 5/2017 | Lam | |
| 10,087,616 | B1 | 10/2018 | Lam | |
| 10,533,324 | B2 | 1/2020 | Baltz, Jr. et al. | |
| 11,365,548 | B1 * | 6/2022 | Meeks | E04F 21/00 |
| 2006/0254169 | A1 * | 11/2006 | McFadden | E04F 13/06 52/344 |
| 2018/0371766 | A1 * | 12/2018 | Anzalone, Jr. | E04F 19/0486 |

* cited by examiner

WALL STRUCTURE WITH HORIZONTAL BASE STUD

CROSS-REFERENCE TO RELATED APPLICATIONS

This application claims the benefit of U.S. Provisional Application No. 63/146,668, filed Feb. 7, 2021; and U.S. Provisional Application No. 63/238,841, filed Aug. 31, 2021, the disclosures of which are hereby expressly incorporated by reference herein in their entirety.

FIELD OF THE INVENTION

This invention relates to the creation of a new category of wall construction that employs horizontal studs at the base of the wall, and above the floor. It can be used in new construction, renovation, and remodeling. When installed at the bottom of a wall, this horizontal base stud system addresses the problem of how to keep drywall dry during a plumbing leak, water intrusion, or flood, by raising the drywall up off of the floor.

In new construction, the horizontal base stud will be installed first near ground level, then the drywall can be installed immediately above the horizontal base stud. In renovation or remodeling applications, the bottom of the existing drywall can be removed at, or below, the height of the baseboard or cove base being used. The horizontal base stud can now be installed directly to the existing framed wall and vertical studs. Finally, the baseboard or cove base can be installed directly over, and in front of, the now hidden horizontal base stud system for a finished appearance.

BACKGROUND OF THE INVENTION

The present invention relates to wall structures with a horizontal base stud which enables quick repair from plumbing leaks or other water damage.

In typical construction, walls are covered with a board material, called drywall. Because the drywall is installed with a lower edge adjacent the floor of the room, any water intrusion from flooding, or a leak from plumbing systems, such as showers, toilets, sinks, etc., can cause significant damage from splashing, soaking, water wicking, where mold and mildew can potentially grow in the areas that are damaged. Many times the water damage will not be discovered early, and the water may accumulate several inches on the floor. Once the water is removed from the floor, the remaining clean up is time consuming and costly. The water will have soaked into the wall material, and if left untreated, mold and mildew will grow creating contamination and health issues.

To address the water and flood damage on the wall, the remediation team will contain the area, and then use air blowers, air scrubbers, and dehumidifiers to dry out the affected area. While the air-drying process is being completed, the portion of the wall that has been damaged by the water must be repaired. Typically, the bottom portion of the wall is covered with a base board, or cove base. The first step in the repair process is to remove the base board or cove base. The next step is to remove the wall portion damaged by the water. This step involves cutting out the wet or damaged portion of the wall. During this cutting process, dust and debris are created, and is dispersed throughout the room. This dust and debris must later be cleaned up before the room can be considered clean. After the wet or damaged portion of the wall is removed, the affected area is treated to ensure mold and mildew are removed, and future growth inhibited. This may include applying a mold and mildew treatment solution, and additional drying steps. Until the room is completely dried, and cleaned, the room must remain vacant, and cannot be used. The drying alone time can typically range from 24 to 72 hours. This results in significant business disruption and loss of revenue.

After the room has dried, the wall must then be repaired. This involves significant carpentry and usually additional metal bracing work, depending upon the type of studs and wall configuration used in the construction. The construction of the wall may involve wooden or metal studs. While metal studs are typically used in commercial and industrial applications, they are now becoming popular in residential construction, renovations, and remodeling. The opening created from the removal of the wet or damaged wall portion is measured, and a replacement piece is cut to fit the opening and is attached to the wall. The painters then patch the opening, seal the joints, and repaint the room. As is evident, the entire process involves several steps and time, requiring the services of outside contractors, carpenters, painters, and housekeeping personnel, all the while making the room unusable. In hospital situations, the need to ensure complete remediation through drying, construction repair, painting and cleaning is critical to continue patient care. The length of time the room is not being used for patient care is time consuming and costly.

What is needed is a wall structure that can be easily repaired in cases of plumbing leaks, water intrusions, and floods; and which repair process does not require the need to replace a portion of the wall itself; and yet allows the area to be dried, and the growth of mold and mildew to be avoided.

SUMMARY OF THE INVENTION

In one aspect, this invention is a wall structure containing a horizontal base stud. The wall structure comprises a first wall panel, a horizontal base stud, and a vertical support stud. The first wall panel is secured to the vertical support stud and sits above the horizontal base stud. The wall panel has an inner surface facing the vertical support stud, and an exterior surface facing away from the vertical support stud. The horizontal base stud is secured to the vertical support stud below the wall panel, and has a top portion adjacent a bottom edge of the wall panel, and a bottom portion adjacent but spaced above a floor. The base stud further comprises a front surface, and the front surface has an opening which would allow air flow to the inner part of the wall structure.

In another aspect, this invention is a process for remediating water damage from a plumbing system leak, water intrusion, or flood. The process comprises installing a wall structure having a horizontal base stud. The wall structure comprises a first wall panel, a horizontal base stud, and a vertical support stud. The first wall panel is secured to the vertical support stud and sits above the horizontal base stud. The wall panel has an inner surface facing the vertical support stud, and an exterior surface facing a room. The horizontal base stud is secured to the vertical support stud below the wall panel, and has a bottom portion adjacent a floor. The bottom portion of the horizontal base stud has an opening which would allow liquids to escape from the inner part of the wall structure. The horizontal base stud further comprises a front surface, and the front surface has an opening which would allow air flow to the inner part of the wall structure. The process further comprises installing a coping piece, which can be a base board, over the front surface of the horizontal base stud. Additionally, once there is a water intrusion, flood or leak from the plumbing system in the room, the coping piece is removed from the horizontal base stud. After removing the coping piece, air dryers or air blowers move air through the openings in the horizontal base stud, thereby drying the inner surface of the wall panel.

The wall structure of this invention enables a quick and easy method for drying a wall after a plumbing leak, water intrusion, or flood. When those events do not involve water exceeding the height of the horizontal base stud, no removal or repair of the wall panel is needed. All that is required is removal of the coping piece or baseboard, drying of the area, and replacing the coping piece or baseboard. Because the wall panel has not incurred water damage, the need for mold and mildew remediation is possibly avoided.

This summary is provided to introduce a selection of concepts in simplified form that are further described in the Detailed Description. This summary is not intended to identify key features of the claimed subject matter, nor is it intended to be limiting, or used as an aid in determining the scope of the claimed subject matter.

DESCRIPTION OF THE DRAWINGS

The foregoing aspects and many of the attendant advantages of this disclosure will be apparent by reference to the following detailed description, when taken in conjunction with the accompanying drawings.

DETAILED DESCRIPTION OF THE INVENTION

Figure 1:
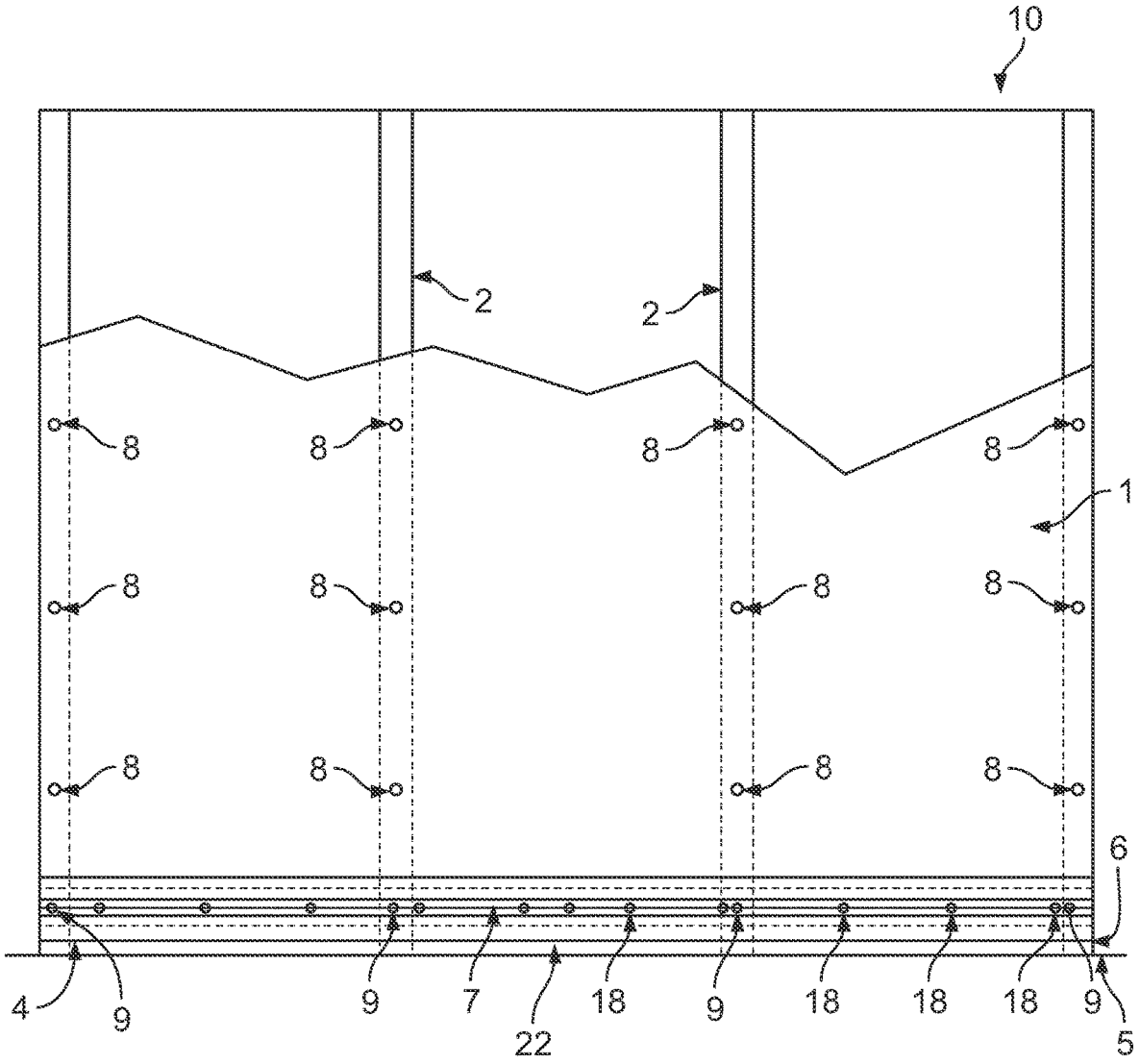
FIG. 1, shows a front view of the wall structure of this invention

A wall structure 10 of a preferred embodiment of this invention is shown in FIG. 1. A wall panel 1 is shown secured to vertical studs 2 via screws 8, above horizontal base stud 4. Base stud 4 is shown spaced 22 apart and above floor 5. Wall panel 1 can be made of conventional panel materials known in the at, such as drywall, solid wood, faux wood, particle board, laminate, metal, plastic, and the like, and can be in any thickness. Preferably, the material is drywall, and is ½ or ⅝ inch thick. Wall panel 1 is secured to vertical studs 2 by conventional means, such as via adhesive, and/or screws 8. Vertical studs 2 are made of materials known in the art, and in an industrial setting, are preferably metal, such as steel or aluminum. Wall panel 1 is secured above horizontal base stud 4. The horizontal base stud 4 is secured to vertical studs 2 through an indented central portion 7 via typical mean, and preferably via screws 9. The thickness of the inden is the same as thickness of the wall panel, and the indented portion is provided in the mid-point of the width of the horizontal base stud. Base stud 4 can be made of conventional construction materials, and is preferably made from galvanized steel. The horizontal base stud 4 is made by running a large roll of flat steel through a roll form machine, and can be of any height, width of depth, with the width preferably matching the width of the wall panel. Horizontal base stud 4 is shown spaced apart 22 of the floor surface 5 to allow water to escape from the inner part of the wall structure to the exterior. Preferably, the bottom portion or edge 6 of the base stud 4 is spaced one-quarter inch above the floor surface 5. The indented central portion 7 of the base stud 4 has openings 18 in it which provide air flow between the exterior and inner part of the wall structure.

Figure 2:
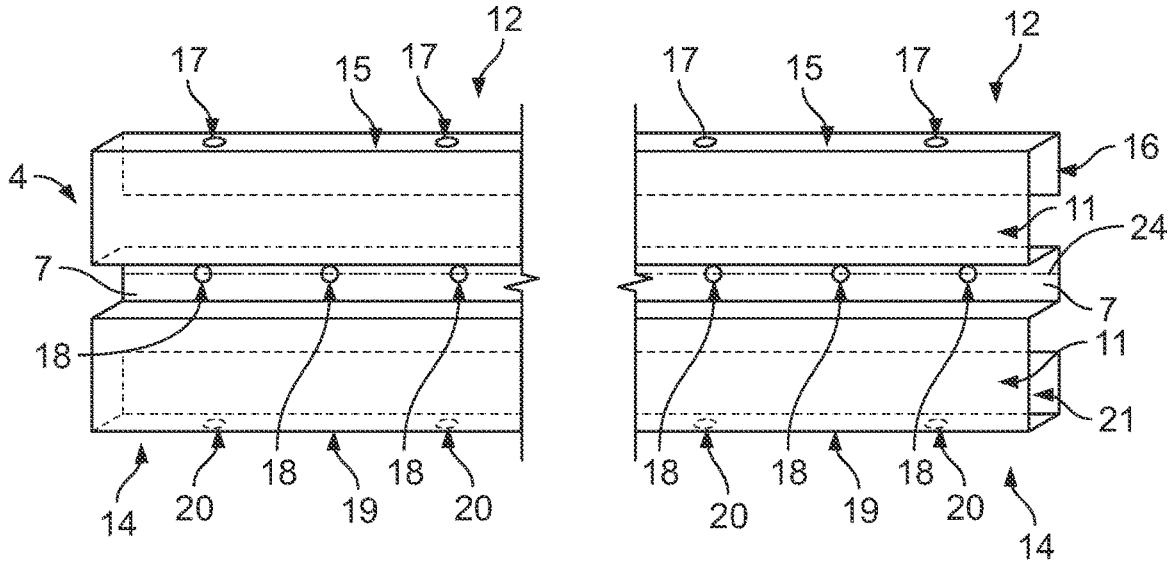
FIG. 2, shows a front perspective view of the base stud used in this invention showing the top surface of the base stud.

A preferred horizontal base stud 4 used in this invention is shown in FIG. 2. Base stud 4 has front face 11, top portion 12, inner indented portion 7, and bottom portion 14. The width of base stud 4 can vary, but preferably, the width is three and three eighths inches from the top portion 12 to bottom portion 14. As shown, top portion 12 is preferably bent at 90 degrees from front face 11 to provide a top surface 15, wherein top surface 15, is bent 90 degrees to provide back leg 16. The width of top surface 15 can vary, but preferably matches the thickness or depth of wall panel 1. Top surface 15 contains at least one opening 17, which can be made by conventional means such as drilling, lasers, press punch, hole punch, and the like. Indented portion 7 preferably has an indent width matching the width of the top surface 15. Inner indented portion 7 can be located at any part of the front face 11, and is preferably located in the center of the portion of the horizontal base stud. Horizontal base stud 4 is secured to vertical support studs (not shown) through indented portion 7. Preferably, screws (not shown) are used to secure base stud 4 to the vertical support studs (not shown), and the screws can be aligned on indented portion 7 by using a score line 24. Preferably, the indented portion 7 further comprises at least one opening 18 to allow air flow from the exterior room to the interior of the wall structure. Optionally, front face 11 could also comprise openings instead of, or in addition to the openings in indent 7. Just as in the top portion 12, bottom portion 14 is bent 90 degrees to provide bottom surface 19. Bottom surface 19 comprises at least one opening 20, and has a portion bent 90 degrees to provide for back leg 21. The openings 20 provide weep holes to allow liquids, such as water, from a plumbing leak to escape. Bottom surface 19 has the same width as top surface 15.

Figure 3:
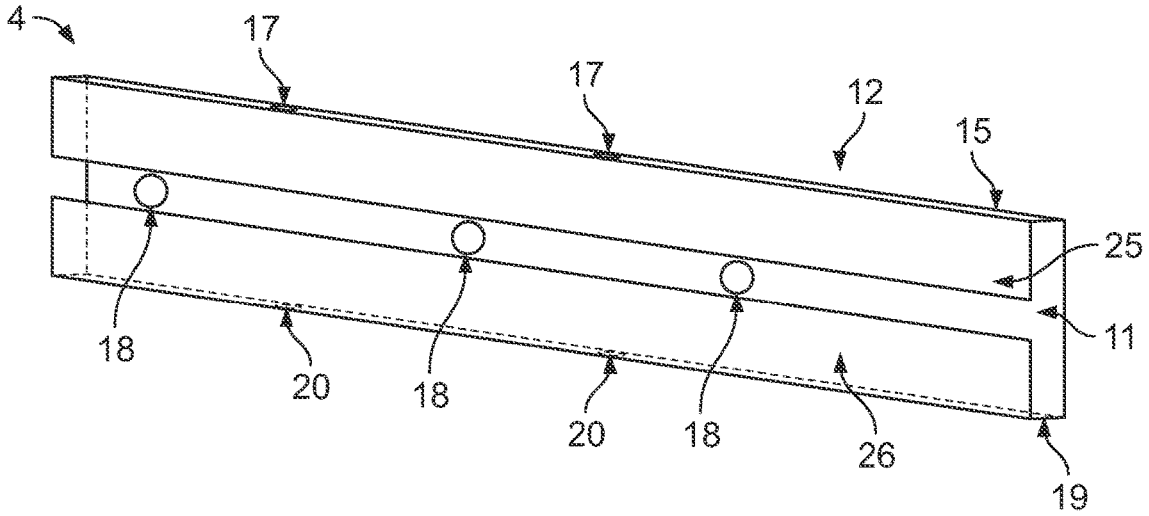
FIG. 3. Shows a front perspective view of an alternative base stud used in this invention showing the top surface of the base stud.

Another alternative of the horizontal base stud of this invention is a flat panel with front facing legs at the top and bottom as is shown in FIG. 3. The flat panel will be secured to the vertical studs (not shown) as is described above, will have a bottom edge adjacent but spaced above the floor, and will have holes 18 punched into the front surface 11 to allow air to flow to the inner part of the wall structure. Top portion 12, and bottom portion 14 are bent to provide top surface 15, and bottom surface 19, and legs 25 and 26 are provided so that a coping piece or base board (not shown) can be attached to cover the base stud. Holes 17 are in top surface 15, and holes 20 are in the bottom surface 19. Top surface 15, and bottom surface 19 have the same thickness as wall panel 1.

Figure 4:
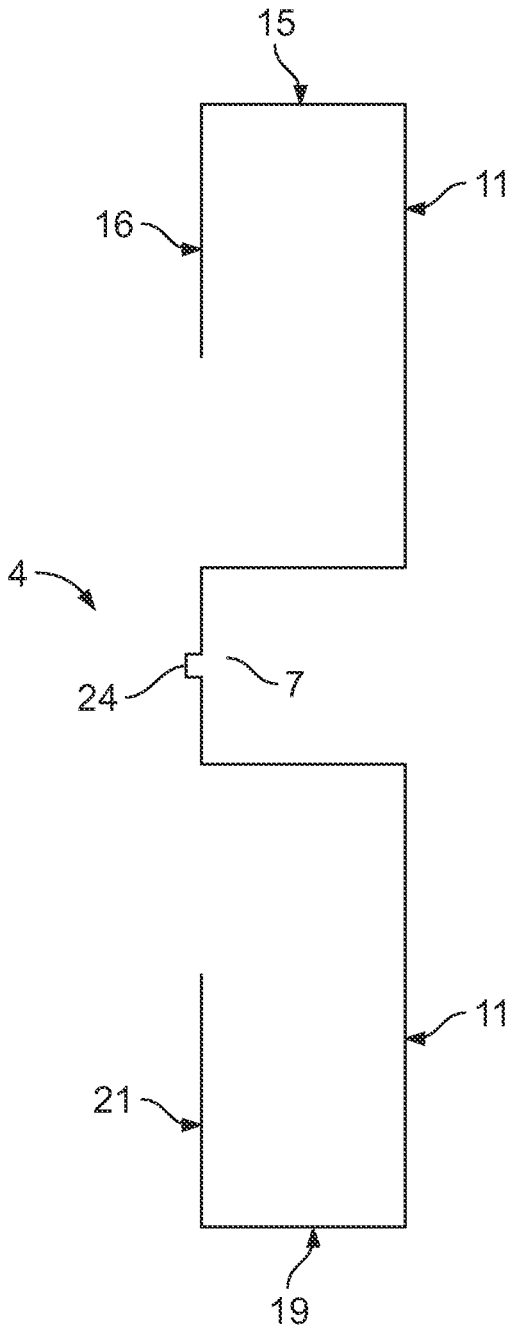
FIG. 4 shows a side view of a preferred base stud used in this invention.

From FIG. 4, the side view of base stud 4 shows front face 11; indent 7; top surface 15 with back leg 16; and bottom surface 19 with back leg 21.

Figure 5:
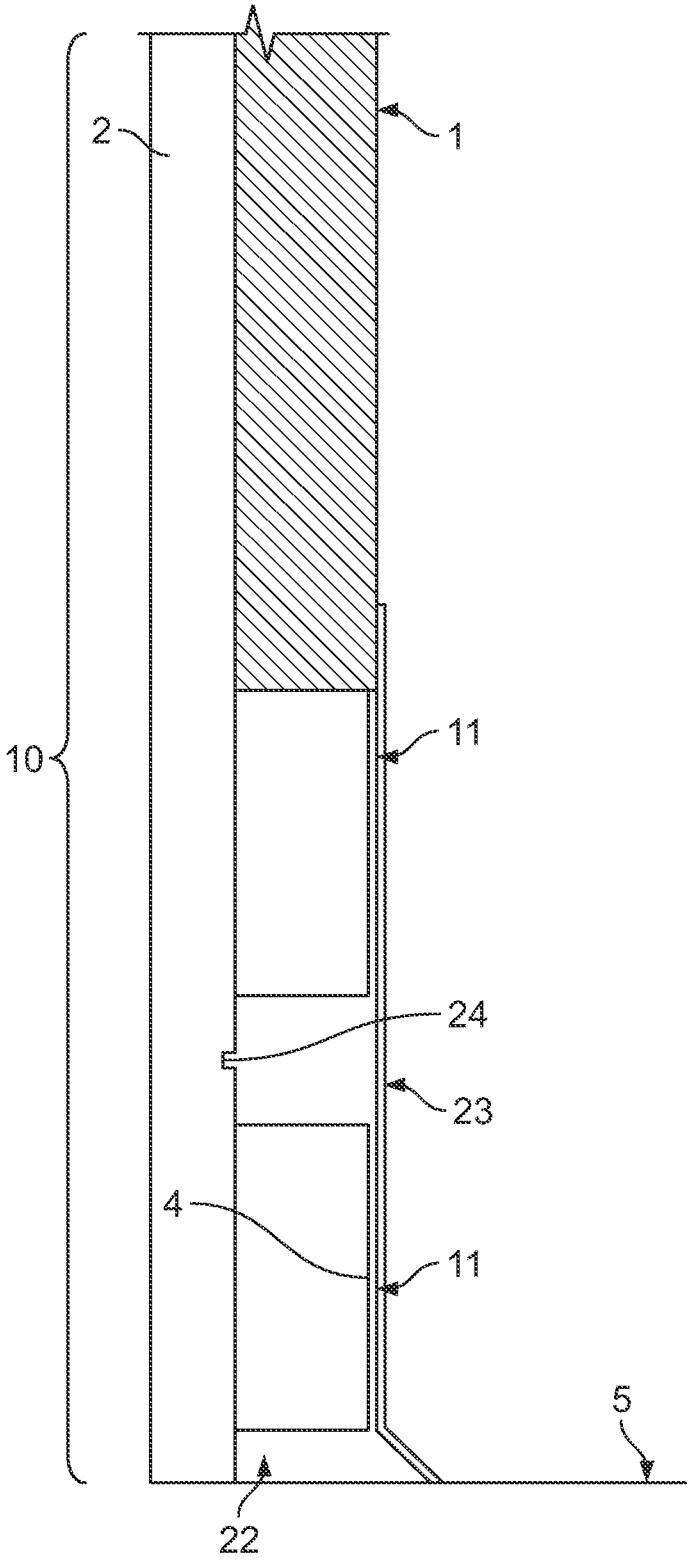
FIG. 5. Shows a side view of a preferred wall structure used in this invention.

From FIG. 5, a side view of the wall structure 10 of this invention is shown. Wall panel 1 is shown sitting above horizontal base stud 4, and attached to vertical stud 2. Base stud 4 is shown sitting above floor 5 via space 22. Additionally, FIG. 5 shows coping 23 covering the front face 11 of base stud 4.

Figure 6:
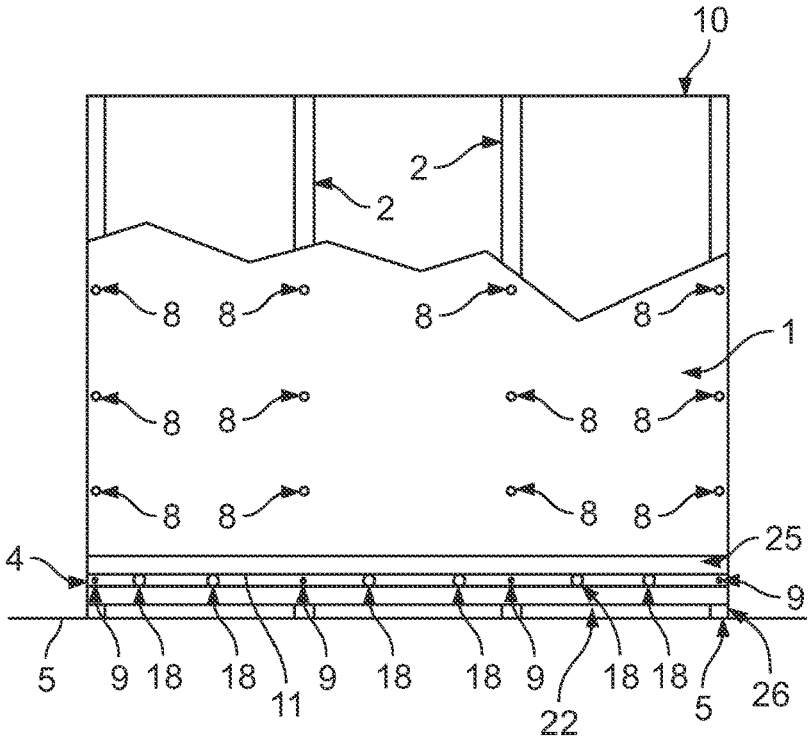
FIG. 6. Shows a front view of a wall structure of this invention showing an alternative base stud useful in this invention.

In FIG. 6, an alternative wall structure 10 is shown with the base stud shown in FIG. 3. Wall panel 1 is attached to vertical studs 2 via screws 8, and is disposed above horizontal base stud 4. Base stud 4 is comprised of a flat panel with a front surface 11 has openings 18 punched through it to allow air passage from the front of the wall structure to the interior of the wall structure. Openings 18 can be of varying sizes. Base stud 4 is secured to vertical studs 2 via screws 9. The base stud has top and bottom portions that are bent to provide legs 25 and 26 to which a coping piece or baseboard (not shown) can be attached. The base stud 4 is spaced apart 22 from floor 5.

Figure 7:
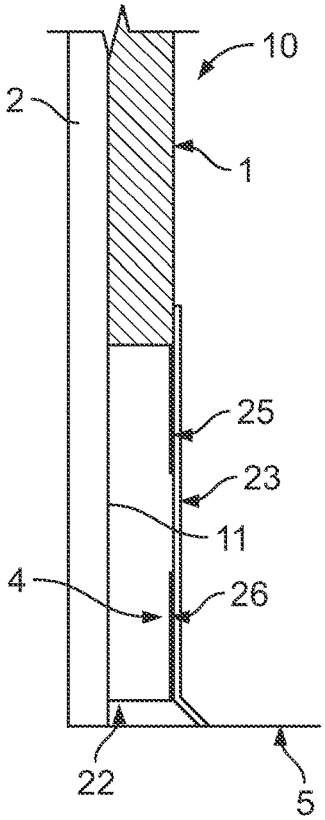
FIG. 7 shows a side view of a wall structure of this invention with the alternative base stud useful in this invention.

FIG. 7. Shows a side view of the wall structure shown in FIG. 6. Wall structure 10 has wall panel 1 disposed above horizontal base stud 4 and attached to vertical stud 2. Base stud 4 has a fat panel adjacent vertical stud 2, and leg 25 on the top portion, and leg 26 on the bottom portion. Coping piece 23 is shown attached to leg 25 and leg 26. Base stud 4 is spaced 22 above floor 5.

The wall structure of this invention can be made using conventional construction methods and materials. Typically, the walls of a room are first framed using vertical studs attached to a top and bottom track. Vertical studs are placed at regular intervals, typically 16 or 24 inches apart. Once the framed wall is in place, it is attached to the floor and ceiling, than the wall panels are secured to the vertical studs. In a first method of this invention, the horizontal base stud is first installed near the bottom of the framed wall by attaching it to the vertical studs. The wall panel is then installed above the horizontal base stud. In an alternative method, the wall panel is attached to the vertical studs with enough open space at the bottom to install the horizontal base stud slightly up off of the for, and then attaching the base stud to the vertical studs. The horizontal base stud preferably has a number of openings on the front surface of the stud to allow air flow from the front surface to the interior area of the wall structure, meaning the area between the back surface of the wall panel, and the vertical support studs. Preferably, there are multiple openings spaced 5 inches apart, and the openings can be of varying sizes to allow for the efficient flow of air. The base stud has top and bottom surfaces that match the width of the wall panel. The top and bottom surfaces have openings spaced preferably 21 inches apart from each other. The final piece of the wall structure is a coping base, or base board that is attached to the front surface of the horizontal base stud.

The wall structure can house a plumbing system either on the inside portion of the wall structure or in a room containing the plumbing system. The plumbing system can be made up of conventional parts including pipes, sinks, drains, toilets, showers, and the like. If there is a leak in the system, the liquid or water can flow out from the weep or drain holes in the bottom surface of the horizontal base stud, or trough the gap located between the bottom surface of the horizontal base stud and floor. After a plumbing leak, water intrusion, or flood occurs, the coping piece or base board can be removed from the front face of the horizontal base stud. Thereafter, air blowers, air scrubbers or dehumidifiers can be introduced, and aimed toward the wall structure. As the blowers are activated, air is transferred to the interior portion of the wall structure through the openings in the horizontal base stud to dry the interior of the wall structure without having to remove any part of the wall panel.

Figure 8A:
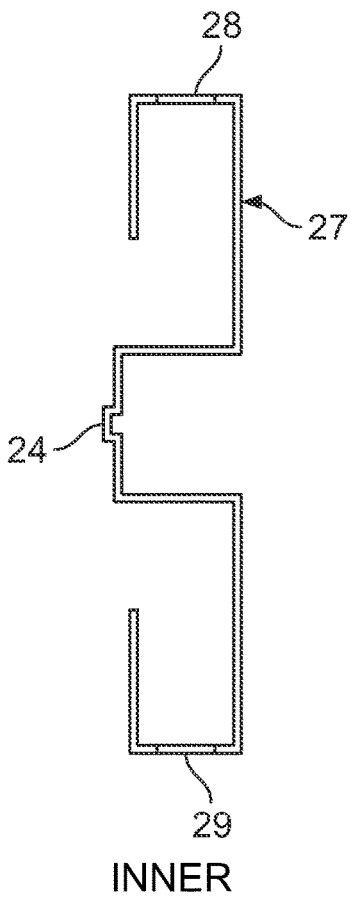
FIG. 8*a-c* shows a side view of a nested version of the horizontal base stud of this invention where an inner spline is nested into the outer base stud.
Figure 8C:
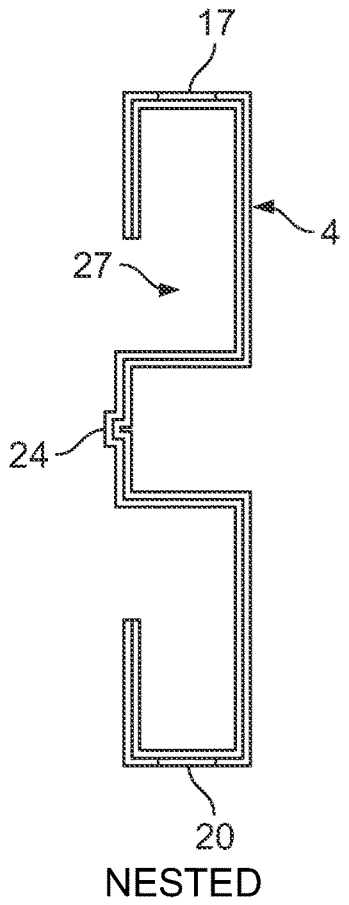
Figure 8B:
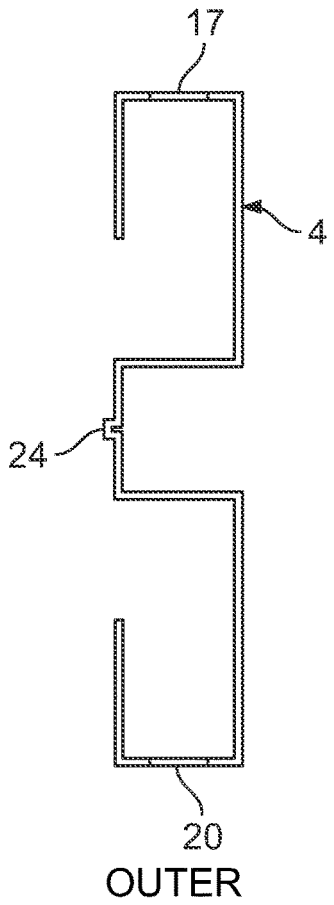
Figure 9:
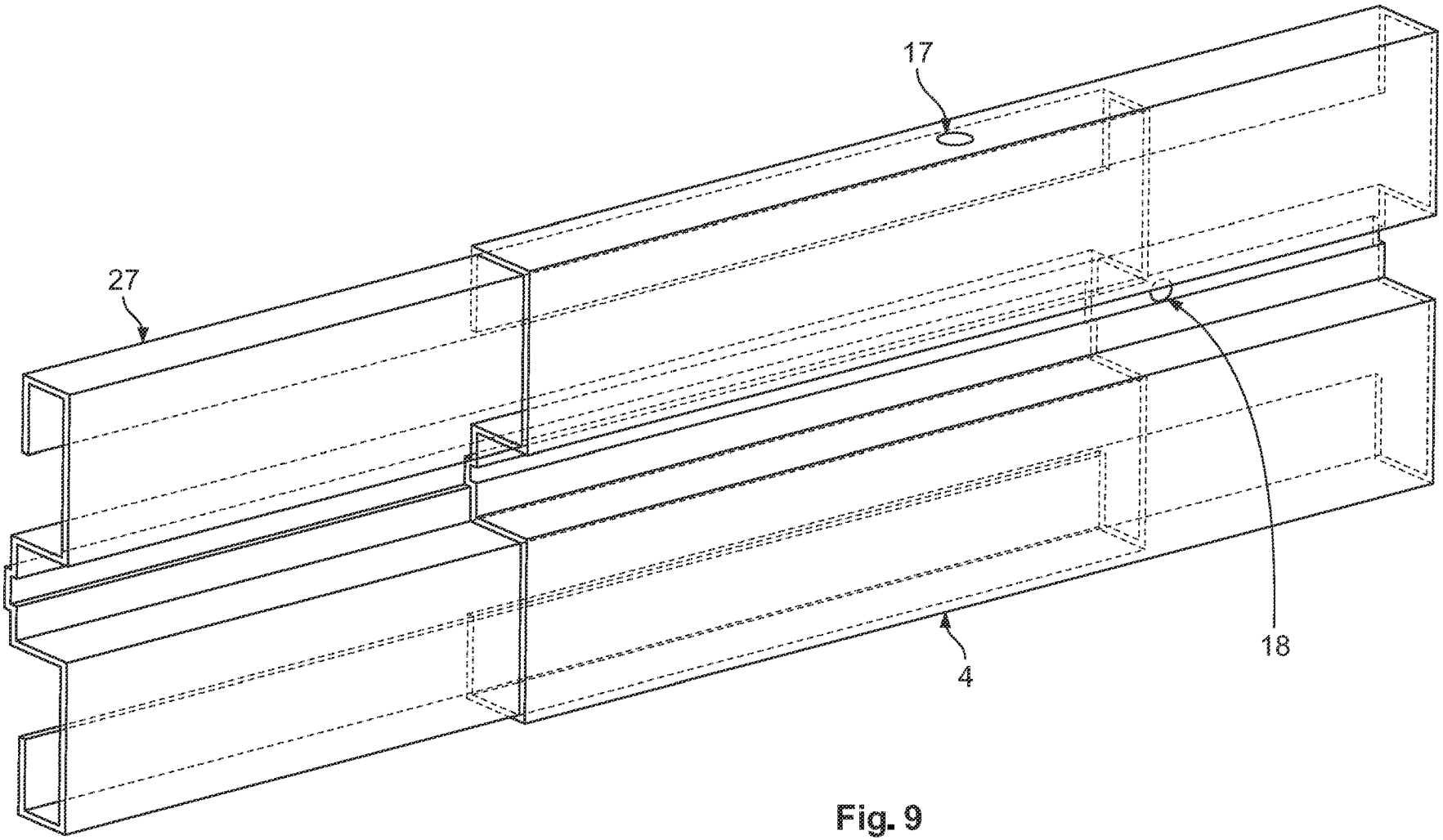
FIG. 9 shows a perspective view of the nested version of the horizontal base stud of this invention with an inner spline nested into the outer base stud.
Figure 10:
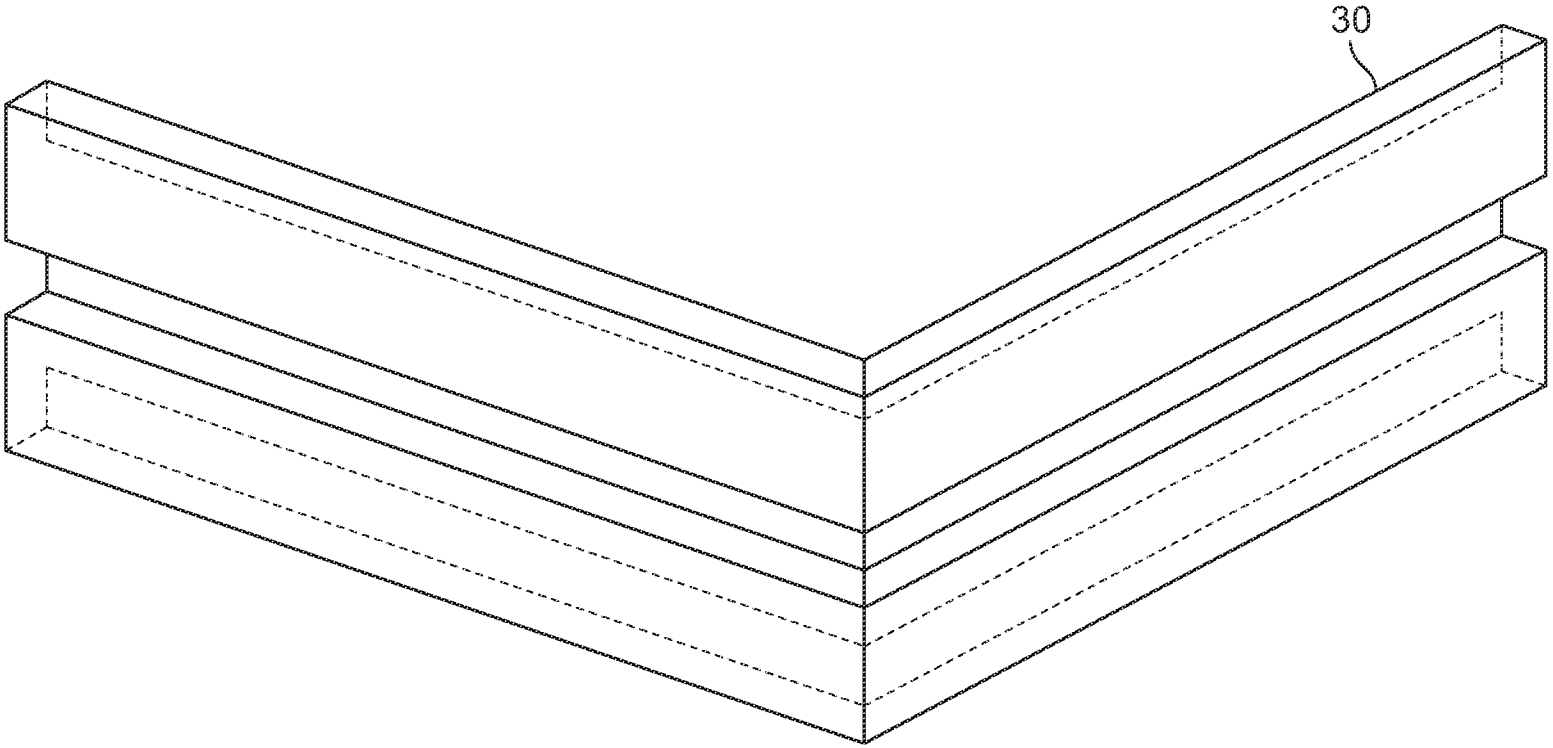
FIG. 10 shows a perspective view of a corner connection piece for the horizontal base stud of this invention.

The wall structure with the horizontal base stud can have further components such as an extender that interlocks and slides freely into the back side of the horizontal bases stud pieces such as are shown in FIG. 8. In FIG. 8*a*, an inner spline piece 27 is shown and has the same shape as outer base stud piece 4 which is shown in FIG. 8*b*. Spline piece 27 will also have openings 28 in the top surface, and 29 in the bottom surface to facilitate air flow in the same manner a the openings 17 and 20 in the horizontal base stud. Inner piece 27 is shown nested into outer base stud piece 4 in FIG. 8*c*. FIG. 9 also shows the nested inner piece 27 into outer base stud 4. Shorter spline pieces can also be used to interlock and slide into the back side of the horizontal base stud pieces. These pieces work well with the horizontal base studs formed with indents, and top and bottom surfaces with back legs. Additionally, inside and outside corner pieces can be used. FIG. 10 shows a corm connector 30 for the horizontal base studs useful in this invention. The corner connector will have the same shape as the horizontal base stud 4 so it can nest inside base stud 4. The horizontal base stud can also be fabricated, via notches or kerfs, to provide both an inside radius horizontal base stud, and an outside radius horizontal base stud piece. The width of the base stud can vary depending upon the risks of plumbing damage in the specific construction project.

Figure 11A:
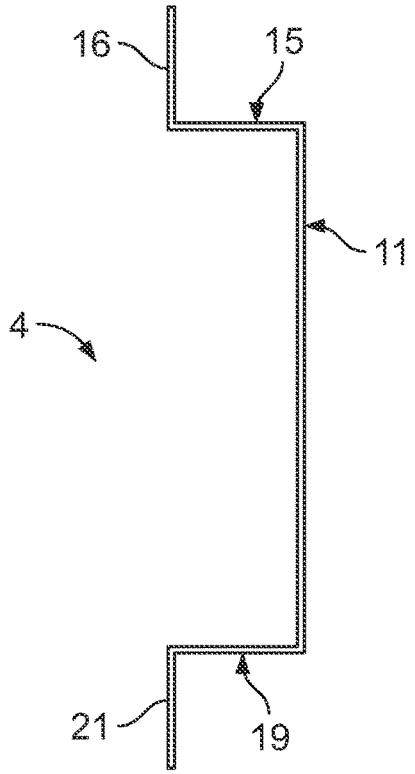
FIG. 11*a-b* shows an alternative version of the horizontal base stud of this invention.
Figure 11B:
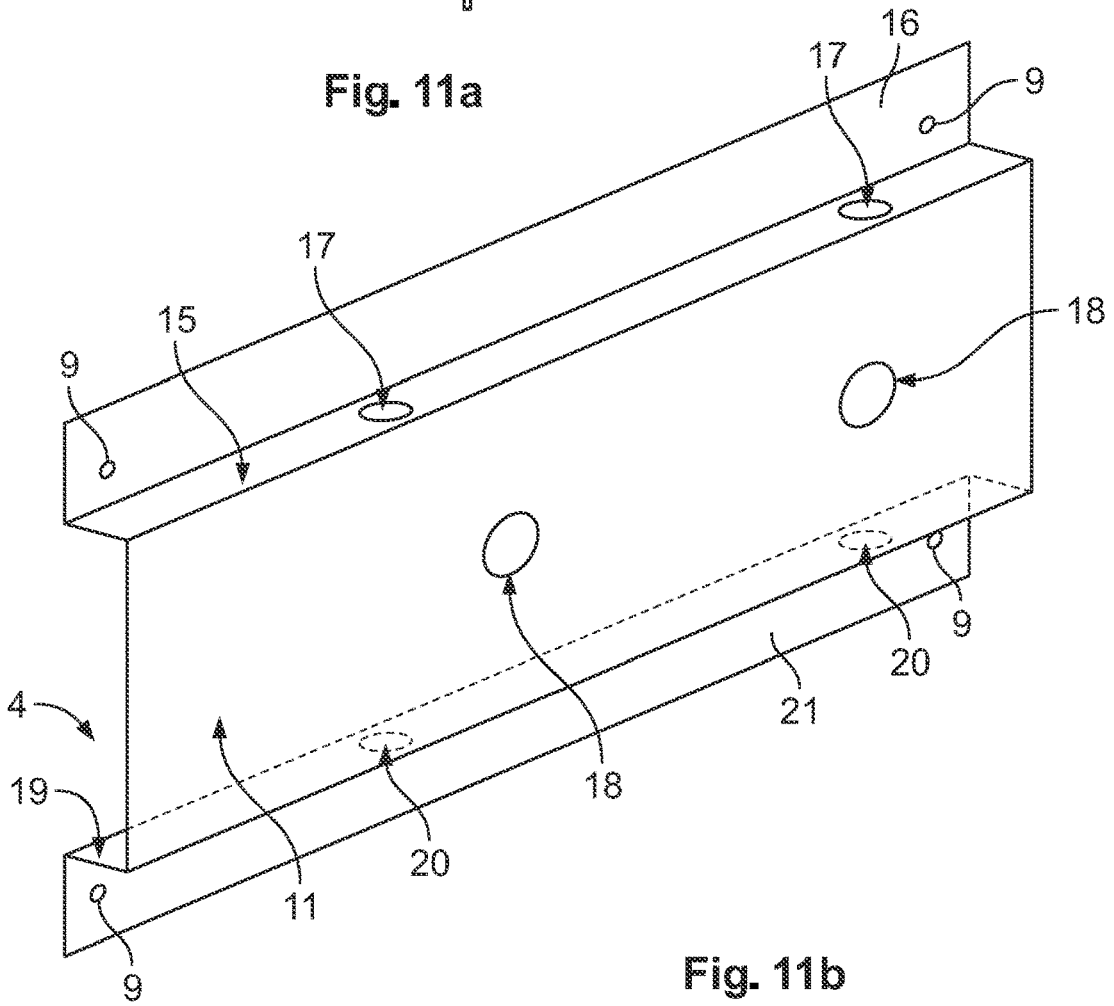

FIG. 11*a* shows yet another alternative base stud 4 of this invention. Base stud 4 has leg 16 at the upper portion 12, and leg 21 at the lower portion 19, and can be affixed to vertical studs (not shown) via screws 9. Base stud 4 has front face 11, which will have openings 18 punched through. FIG. 11*b* shows a perspective view of the base stud 4 of FIG. 11*a*. From FIG. 11*b*, holes 17 in the top portion 15, and holes 20 (in phantom) in bottom portion 19 are shown.

The advantages of the wall structure of this invention are many, and there is nothing available in the industry to address the problem of water damage remediation in a quick and efficient manner, or the other benefits of employing a horizontal base stud as disclosed in this invention. The horizontal base stud can be employed in permanent and non-permanent walls. Since the horizontal base stud can be made from any material that does not absorb water, such as metal, plastics, etc., the builder has design flexibility to meet the structural and budget demands of the job. The materials selected for the horizontal base stud can be of structural or non-structural strength; can be fire rated, or non-fire rated; can be solid or perforated; insulated or non-insulated. The horizontal base stud can be made of varying height, depth or width to meet the specifications of the job. The materials can come in a variety of colors to fit the aesthetics of the job. Typically, the metal or plastic used to make the horizontal base stud will be lighter than the wall material it replaces, and it will not warp or rot. Further, because it is not made of wood, the horizontal base stud is resistant to pests, much as termites or carpenter ants.

What is claimed is:

1. An interior wall structure having a horizontal base stud, said wall structure comprising a first wall panel, the horizontal base stud, and a vertical support stud; said first wall panel being secured to the vertical support stud, and sitting above the horizontal base stud; said wall panel having an inner surface facing the vertical support stud, and an exterior surface facing away from the vertical support stud; said horizontal base stud being secured to the vertical support stud below the wall panel, and having an upper portion adjacent a bottom edge of the wall panel, and a bottom portion adjacent but spaced above a floor; and aid horizontal base stud further comprising a front surface having an opening sufficient to allow air flow to an inner surface of the interior wall structure and the floor below the inner surface of the interior wall structure.

2. The interior wall structure of claim 1, wherein the bottom portion of the horizontal base stud has a flat surface bent from the front surface and sitting spaced above the floor, and said flat surface having an opening.

3. The interior wall structure of claim 2, wherein the flat surface is beat 90 degrees from the front surface.

4. The interior wall structure of claim 3, wherein the front face of the horizontal base stud has more than one opening, and the flat surface of the bottom portion has more than one opening.

5. The interior wall structure of claim 4, wherein the top portion of the horizontal base stud has a flat surface beat from the front surface.

6. The interior wall structure of claim 5, wherein the flat surface is bent 90 degrees from the fit surface of the horizontal base stud.

7. The interior wall structure of claim 6, wherein the openings in the flat surface of the bottom portion of the horizontal base stud allow water to escape from the inside portion of the wall structure.

8. The interior wall structure of claim 7, wherein the interior wall structure is employed in a room containing a plumbing system.

9. The interior wall structure of claim 8, wherein the plumbing system is employed on the inner surface of the interior wall structure.

10. The interior wall structure of claim 9, wherein a coping piece is attached to the front surface of the horizontal base stud.

* * * * *